United States Patent [19]

Graham, Jr.

[11] 4,184,681

[45] Jan. 22, 1980

[54] RAM-AIR INFLATABLE, FABRIC, TOWED GUNNERY TARGET

[75] Inventor: John J. Graham, Jr., Cuyahoga Falls, Ohio

[73] Assignee: Goodyear Aerospace Corporation, Akron, Ohio

[21] Appl. No.: 828,462

[22] Filed: Aug. 29, 1977

[51] Int. Cl.[2] ..... F41J 9/10

[52] U.S. Cl. ..... 273/105.3; 244/1 TD

[58] Field of Search ..... 273/105.2, 105.3; 40/215; 244/33

[56] References Cited

U.S. PATENT DOCUMENTS

| | | | |
|---|---|---|---|
| 1,376,121 | 4/1921 | Smyth | 244/33 |
| 1,686,646 | 10/1928 | Upson | 244/33 |
| 1,860,982 | 5/1932 | Binnie | 273/105.3 |
| 2,270,884 | 1/1942 | Manson | 273/105.3 |
| 2,777,696 | 1/1957 | Magill | 273/105.3 |
| 2,795,778 | 6/1957 | Bagby | 293/105.3 |
| 2,927,793 | 3/1960 | Del Mar | 273/105.3 |
| 2,930,619 | 3/1960 | Greenwood | 273/105.3 |
| 3,000,634 | 9/1961 | South | 273/105.3 |
| 3,395,877 | 8/1968 | MacFadden et al. | 244/33 |
| 3,993,269 | 11/1976 | Crosby | 244/33 |
| 4,000,867 | 1/1977 | Daikeler et al. | 273/105.3 |

FOREIGN PATENT DOCUMENTS

| | | | |
|---|---|---|---|
| 1194536 | 10/1959 | France | 273/105.3 |
| 1242052 | 12/1959 | France | 273/105.3 |

*Primary Examiner*—Richard C. Pinkham
*Assistant Examiner*—Lawrence E. Anderson
*Attorney, Agent, or Firm*—P. E. Milliken; E. W. Oldham; R. L. Weber

[57] ABSTRACT

A ram-air inflatable, fabric, towed gunnery target for air, land, and naval defense practice having a rigid enclosed nose cone and a flexible inflatable envelope with aft inflation inlets and finlet stabilizers is presented. The gunnery target is foldable for storage and deployment, said envelope folded into a rigid extraction module canister and said nose cone serving as the nose cone for said module. The target may be air launched or ground-snatch deployed, said module being air deployed from a pod launcher on the tractor aircraft. The target may be towed for gunnery sorties at speeds and distances exceeding current tow target performance limits. The nose cone contains housing for sensitive detection devices to record hits or near-misses of said target simulated to be hits on an actual aircraft. The target is capable of withstanding multiple bullet perforations and may be recovered from land, sea, or air and refurbished and reused.

5 Claims, 4 Drawing Figures

RAM-AIR INFLATABLE, FABRIC, TOWED GUNNERY TARGET

BACKGROUND OF THE INVENTION

Heretofore, numerous approaches have been taken to provide an aerial gunnery target apparatus. Since World War I when the use of airplanes as war machinery became prevalent, defense forces have needed the use of gunnery targets to practice their accuracy in firing various weaponry. The first embodiment of such aerial devices were rudimentary in that they were merely open-ended sacs which were towed at the end of airplanes at low speed. These aerial devices, such as that disclosed in U.S. Pat. No. 1,860,982, contained a frontal rigid ring opening from which a flexible sac extended. The forward motion of the tractor craft forced wind into the flexible sac. However, by virtue of its means for gathering air, this aerial device had substantial drag and unstable aerodynamics, which prohibited its use at high speeds.

Higher speeds were capable for the aerial tow target disclosed in U.S. Pat. No. 2,930,619, through the addition and use of a plurality of rigid fins extending from the aft portion of the target. The plurality of fins stabilized the target at higher speeds, but the use of a frontal orifice to gather air to inflate the flexible material did not reduce the high drag coefficient.

Methods of deployment of these aerial devices have also evolved. Initially, the air sac lay on the ground and inflated as the tractor aircraft towed it into the air. A method of air deployment of the aerial device was disclosed in U.S. Pat. No. 2,777,696, wherein a torpedo-like housing was released from the end of the tractor aircraft and the snapping force of the tow rope, becoming taut, initiated the housing to separate, allowing the aerial device to unfurl by the passage of air rushing through its frontal orifice. This housing was a bulky structure for attachment to and deployment from high-speed aircraft. The aerial target needed to serve as a structure simulating larger aircraft. Therefore, besides maintaining shape when perforated by bullets, the aerial target had to be capable of monitoring "near-misses" which simulated "hits" on an aircraft through the use of sensitive electronic devices. Inflatable aerial targets utilizing frontal orifices had no structure within which electronic devices could be housed.

Consequently, it is an object of the instant invention to present a ram-air inflatable, fabric, towed gunnery target wherein the target utilizes streamline design to permit high speed aerial target practice.

It is a further object of the invention to present a ram-air inflatable, fabric, towed gunnery target wherein said target utilizes aft air inlets allowing streamlining of the target nose, thereby reducing the pressure drag coefficient and permitting supersonic flight capability.

Still, a further object of the invention is to present a ram-air inflatable, fabric, towed gunnery target wherein said target contains flexible finlets which serve the dual purposes of gathering air to inflate the target and stabilizing the target during towed flight.

It is a further object of the invention to present a ram-air inflatable, fabric, towed gunnery target wherein the target is deployed in flight or ground snatched.

Yet a further object of the invention is to present a ram-air inflatable, fabric, towed gunnery target which may be compressed into a small container for the purpose of storage before launching in flight.

Still a further object of the invention is to present a ram-air inflatable, fabric, towed gunnery target wherein the target is made from fabric capable of withstanding multiple bullet perforations and transonic shock waves occurring at or near the speed of sound.

Yet a further object of the invention is to present a ram-air inflatable, fabric, towed gunnery target which contains housing for suitable apparatus to measure and record accurate strikes on or near the gunnery target.

Yet a further object of the invention is to present a ram-air inflatable, fabric, towed gunnery target wherein said target is recoverable on land, water, or in air.

A still further object of the invention is to present a ram-air inflatable, fabric, towed gunnery target wherein said target is capable of reuse after each practice sortie deployment.

These objects and other objects, which will become apparent as the detailed description proceeds are achieved by: an apparatus for the storage and deployment of towed gunnery targets, comprising a rigid nose cone assembly as the fore segment and a rigid containment means for housing an open-ended, flexible, inflatable fabric target envelope as the aft segment; the outermost edge of said rigid nose cone assembly attached to said open end of said target envelope; and said rigid containment means also housing a recovery parachute apparatus and means for attaching said rigid containment means to said rigid nose cone assembly.

Generally, an apparatus for aerial target practice, comprises a ram-air inflatable, fabric, towed gunnery target capable of air deployment or snatch deployment; said target having a rigid nose cone assembly and a flexible, inflatable, fabric envelope; said nose cone and said envelope attached by securing means for assembling said target; said nose cone assembly containing rigid material from its apex to its outermost perimeter for forming a frontal-closed, streamlined fore structure for said target; said nose cone assembly containing securing means for attaching a cable which serves to tow said target from a tractor aircraft; said nose cone assembly containing protective means for housing bullet detection devices; and said envelope containing inflation means and stabilization means at its aft end for maintaining the inflated structure and position of said target during a towing operation by said tractor aircraft.

DESCRIPTION OF THE DRAWINGS

For a complete understanding of the objects, techniques, and structure of the invention, reference should be had to the following detailed description and accompanying drawings wherein.

DETAILED DESCRIPTION OF THE PREFERRED EMBODIMENT

Figure 1:
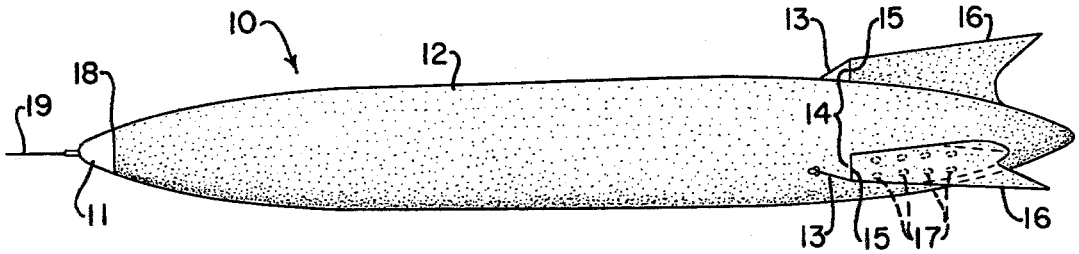
FIG. 1 is a side plan view of the ram-air inflatable, fabric, towed gunnery target.

Referring now to the drawings and more particularly FIG. 1, an understanding of the structure of the invention may be achieved. The ram-air inflatable, fabric, towed gunnery target 10 is composed of the rigid nose cone 11 and the inflatable target envelope 12. At the aft portion of the inflatable target envelope 12 are a plurality of inflatable inlet stabilizers 16, denominated "finlets", the fore portion of each housing a ram-air inflation inlet 14. Maintaining the fully open shape of the inflation inlet 14, normal to the direction of the airstream, is a rigid D-shaped ring 15 captive in the hem of the leading edge of each finlet stabilizer 16. The upper portion of each ring 15 is attached to an inlet erection guy 13, the other end of which is sewn into the fabric of envelope 12. The geometric relationship of the basic envelope fabric 12, the "D" ring 15 and the inlet erection guy 13 effects automatic erection of the inflation inlet 14 to an attitude normal to the air flow as a function of the tension of the fabric of the deployed envelope. Inside the inflatable finlet stabilizers 16 are a plurality of inflation orifices 17, which number is dependent upon the anticipated number of bullet perforations generated during a practice sortie of the gunnery target 10. At the fore portion of the envelope 12 is the fabric nose cone interface 18 which joins the flexible, inflatable target envelope 12 with the rigid nose cone 11. Secured to the rigid nose cone 11 is the end of the tow cable 19, the other end of which is attached to the tractor aircraft.

The target 10 is a pressure-stabilized fabric structure aerodynamically shaped to provide stable flight and low drag. Once the target 10 is inflated, it can be treated aerodynamically, essentially as a rigid body. The positioning of the ram-air inlets 14 on the aft portion of the inflated fabric envelope 12 permits the streamlining of the nose of the target and shifting of the aerodynamic center of pressure aft resulting in a low overall drag coefficient as well as a high margin of static aerodynamic stability. The rigid nose cone 11 and the high finess ratio streamlined shape of the envelope 12 including its tapered aft boattail also contribute to the low drag properties of the target 10. Using a target of this geometry has improved the drag coefficient by a factor from 2 to 10 over the fabric gunnery target structures known in the art. Because of its streamlined shape, the instant gunnery target 10 is completely stable when traveling at speeds from less than 200 miles per hour to greater than Mach 1.25. Furthermore, the flexible nature of the inflatable target envelope 12 significantly aids in withstanding the transonic phenomena which occurs at or near Mach 1.0. The inflatable finlet stabilizers 16 also stabilize the target, such that the target may be towed at distances from the tractor aircraft from less than 600 feet to greater than 5,000 feet.

The number of the inflatable finlet stabilizers 16 may be three or greater, depending upon the aerodynamic demands for the configuration of the gunnery target. The overall size of the target 10 is primarily a function of the visual acquisition requirements. The ram-air inflation inlets 14 and inflation orifices 17 are sized to provide adequate replenishment of inflation air to offset leakage from multiple bullet perforations.

The inflatable target envelope 12 may be made from any conventional fabric known to those skilled in the art which is capable of withstanding multiple bullet perforations (which perforations do not propagate into a catastrophic tear), and which has adequate tensile strength to withstand the pressure-vessel loadings generated by the substantially increased air pressure when the gunnery target 10 is being towed at speeds greater than Mach 1.0. It is particularly desirable to use a fabric which does not fray or run when perforated by a bullet, since this greatly extends the flying time during a particular sortie and reduces the costs of target repair. For example, such fabric may employ plies of synthetic cloth, in a biased arrangement, and bonded to each other by a synthetic elastomer. Water recovery within several hours after jettisoning is possible because, in spite of bullet perforations, sufficient air will be trapped within the envelope 12 to float the target 10.

Figure 2:
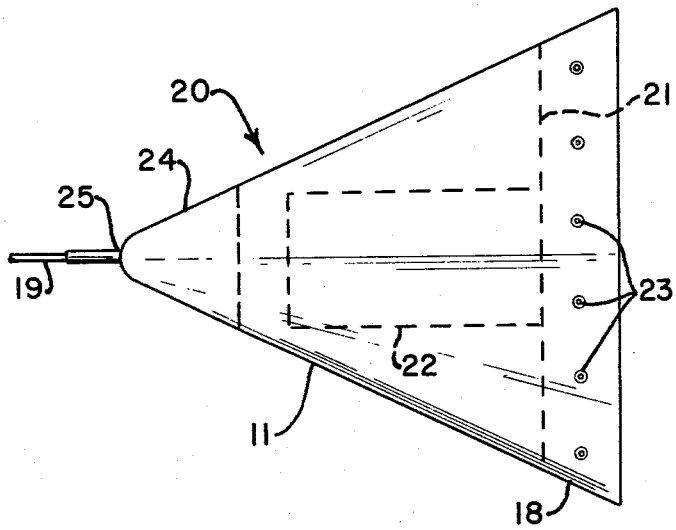
FIG. 2 is a side plan enlarged view of the rigid nose cone assembly.

Referring now to FIG. 2, an enlarged view of the rigid nose cone assembly 20 may be seen. This rigid nose cone comprises nose cone 11 which houses radar detection apparatus 22 protected by the rigid radar bulkhead 21. The radar apparatus 22 may be of the type well known to those skilled in the art, positioned so as to monitor and detect hits upon and misses near the gunnery target 10. The radar bulkhead 21 protects the sensitive radar apparatus 22 from damage during deployment and recovery. At the fore end of the nose cone 11 is a nose plug 24 housing a swivel apparatus 25 which allows the gunnery target 10 to rotate about tow cable 19. The type of swivel apparatus 25 needed for gunnery targets traveling at high speeds is well known to those skilled in the art. The incorporation of a nose swivel precludes the transmission of torque generated by most standard-type tow lines under varying tension loads to the target 10, and conversely permits the transmission of torque, generated by manufacturing asymmetrics in the target 10, from the target 10 to the tow line 19. The rigid nose cone 11 is attached to the inflatable target envelope 12 at the fabric nose cone interface 18 by the use of retainer fasteners 23. If desired, suitable apparatus well known to those skilled in the art may be employed to jettison the envelope 12 from the rigid nose cone 11. The rigid nose cone would be retracted into the pod launcher 44 under the tractor aircraft 42 wing by reversing the deployment, and the inflatable target envelope 12 would be recovered on the land or water, such operations also being well known to those skilled in the art.

Figure 3:
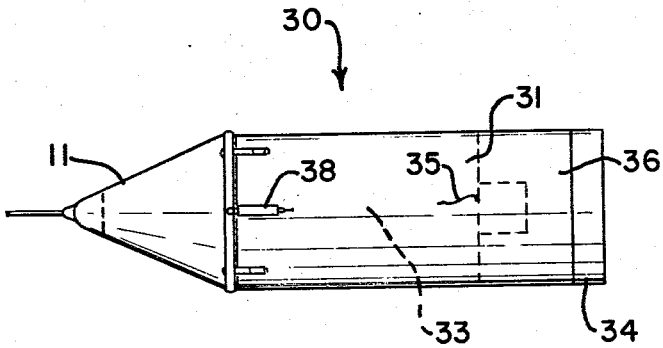
FIG. 3 is a side plan view of the extraction module apparatus.

Referring now to FIG. 3, an understanding of the structure of the extraction module apparatus 30 may be had. Within target canister 31 is an envelope compartment 33 and a recovery parachute apparatus 36. The rigid extraction module 31 is latched onto the rigid nose cone assembly 20 at or near the fabric nose cone interface 18 through the use of a latch and release apparatus 38 which is well known to those skilled in the art. The envelope compartment 33 contains the inflatable target envelope 12 which is folded axially to a width smaller than the diameter of the target canister 31, then accordion-folded into the canister 31. A break cord 35, exposed in FIG. 3 only for purposes of illustration, is attached to the rear of the inflatable target envelope 12 and the aft portion of the target canister 31 before recovery chute apparatus 36, to insure unfolding from the front end first and exposure of the ram-air inflation inlets 14 only after the target has been stretched to its full length. This programmed deployment and inflation sequence reduces dynamic perturbations, insures aerodynamic stability during the transition, and minimizes "lines-stretch" or "opening-shock" loads. Aerodynamic stability of the extraction module 30 during deployment is further enhanced by the use of a stabilizing annular parachute 34 deployed at the aft portion of the target canister 31.

Figure 4A:
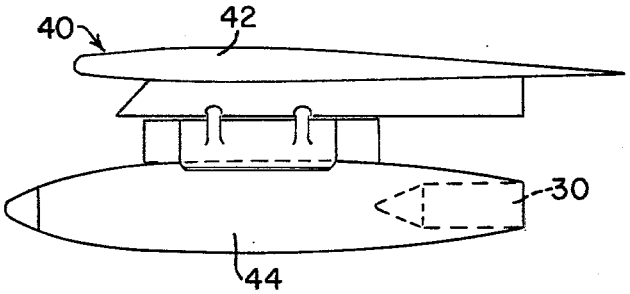
FIG. 4, comprised of FIGS. 4A—4D, is an illustrative diagram of the launch sequence and deployment of the ram-air inflatable, fabric, towed gunnery target.
Figure 4B:
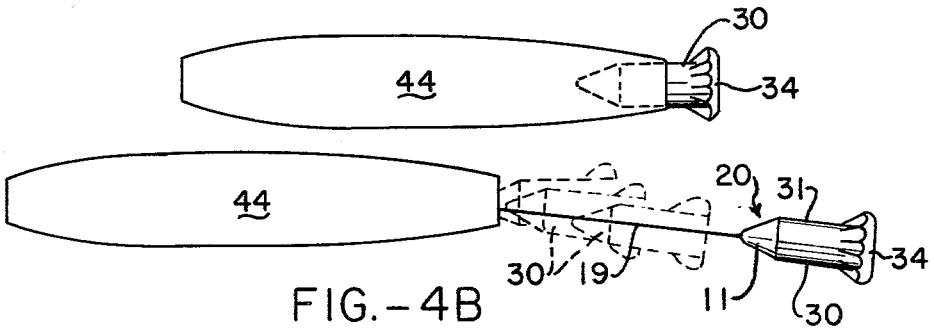
Figure 4C:
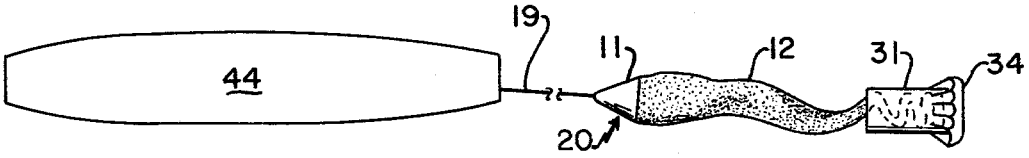
Figure 4D:
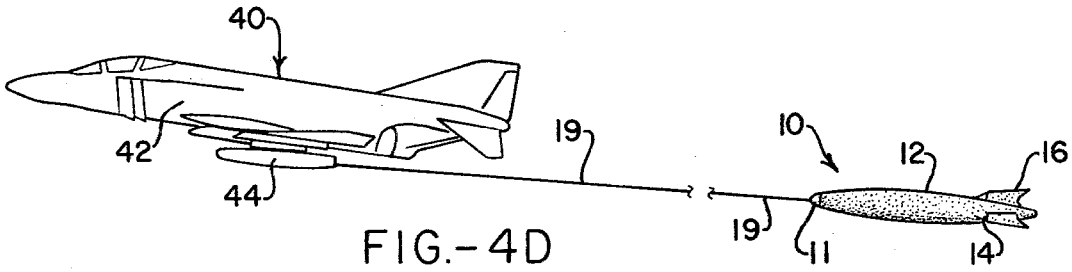
Figure 4:
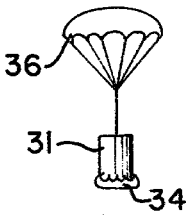

Referring now to FIG. 4, composed of FIGS. 4A—4D, an understanding of the air deployment sequence may be had. The launch sequence 40 begins as the tractor aircraft 42, containing target launcher pod 44, maintains a level flight pattern. Target launcher pod 44 houses at its aft portion the extraction module apparatus 30, as shown by FIG. 4A. At the prescribed time, the operator within the tractor aircraft 42 triggers any one of the suitable means known in the art for increasing the air pressure within the target launcher pod 44. This increased air pressure forces the extraction module apparatus 30 out of the target launcher pod 44 unreeling tow rope 19, assisted by the deployment of the annular parachute 34, as shown by FIG. 4B. After a predetermined time delay, the latch and release apparatus 38 is triggered to release the rigid target canister 31 from the rigid nose cone assembly 20, thereby releasing the envelope 12 of the ram-air inflatable, fabric, towed, gunnery target 10. Once the envelope 12 is fully extended, break cord 35 disengages target canister 31, allowing the inflatable finlet stabilizers 16 to force air into the inflation orifices 17 increasing the air pressure within the inflatable envelope 12 within a very short period of time. Meanwhile, the target canister 31 utilizes its recovery parachute apparatus 36, allowing target canister 31 to be recovered and reused. This extraction module separation occurs as diagrammed in FIG. 4C. The full deployment of the gunnery target 10 is shown in FIG. 4D, as it would appear for use during gunnery practice.

After the ram-air inflatable, fabric, towed gunnery target 10 has served its purpose during target practice, the tow line may be cut at a position within the target launcher pod 44 by means well known to those skilled in the art. The gunnery target 10 maintains its fully inflated shape as it falls to earth at velocities sustainable by the rigid nose cone assembly 20 at impact. During testing it was found that the sensitive radar apparatus 22, when housed in the protective radar bulkhead 21, completely withstood any damage upon impact. Air trapped within the fabric of the gunnery target 10 provides sufficient buoyancy to permit a jettison operation over the water, such that a sensitive and expensive radar apparatus 22 may be recovered over water, where a great number of practice sorties are held.

Besides the method of air deployment as diagrammed in FIGS. 4A through 4D, the ram-air, inflatable, fabric, towed gunnery target may be used as a ground-snatched target in lieu of the air deployment concept. Snatch or drag-off procedures similar to those currently used for banner targets may be employed with the high performance target 10 described herein.

The gunnery target 10 satisfies the current performance requirements of the U.S. Department of Defense for air to air gunnery targets, i.e. 600 KCAS or Mach 1.25.

It should now be readily apparent that a structure has been presented whereby an extraction module apparatus, housing a ram-air inflatable, fabric, towed gunnery target may be deployed; or said fabric gunnery target may be ram-air inflated upon snatch deployment, providing a streamlined target for gunnery practice capable of being towed at subsonic, transonic, and supersonic speeds.

While in accordance with the patent statutes, only the best mode and preferred embodiment of the invention has been presented and described in detail, it is to be understood that the invention is not limited thereto or thereby. Consequently, for an appreciation of the true scope and breadth of the invention, reference should be had to the following claims.

What is claimed is:

1. An apparatus for aerial target practice, comprising:

a ram-air exclusively aft-inflatable, fabric, towed gunnery target capable of air deployment or snatch deployment;

said target having a rigid nose cone assembly and a flexible, inflatable, fabric envelope;

said nose cone and said envelope attached by securing means for assembling said target;

said nose cone assembly containing rigid material from its apex to its outermost perimeter for forming a frontal-closed, streamlined fore structure for said target;

said nose cone assembly containing securing means for attaching a cable which serves to tow said target from a tractor aircraft;

said envelope being attached to the perimeter of said nose cone so as to form a continuous surface when inflated;

said nose cone assembly containing protective means for housing bullet detection devices;

said envelope having a tapered, aft portion, said tapered, aft portion containing inflation inlets for inflating said ram-air exclusively aft-inflatable fabric towed gunnery target attached to the surface of said tapered aft portion, said inflation inlets being the sole means for inflating the target;

said tapered aft portion of said envelope having stabilization means for maintaining the inflated structure and position of said target during a towing operation by said tractor aircraft; and wherein said inflation inlets and said stabilization means at said aft portion comprise a plurality of flexible, inflatable finlet stabilizers.

2. An apparatus as recited in claim 1, wherein said target is shaped as a slender body of revolution permitting a streamlined towing operation from low speeds to supersonic speeds.

3. An apparatus as recited in claim 1, wherein said protective means in said nose cone assembly comprises a rigid bulkhead.

4. An apparatus as recited in claim 1, wherein each of said flexible, inflatable finlet stabilizers has a forward aperture, through which each said stabilizer inflates assuming a rigid shape during said towing operation, each said stabilizer rising normal to the surface of said envelope, positioned equidistant from each other to promote aerodynamic stability during said towing operation.

5. An apparatus as recited in claim 1, wherein each of said flexible, inflatable finlet stabilizers has an inflation inlet having a plurality of orifices on the surface of said tapered aft portion of said envelope, each said inflation inlet formed by said forward aperture of each said flexible, inflatable finlet stabilizer;

said forward aperture of each said finlet stabilizer erected normal to both the surface of said envelope and the air-stream, and maintained by guy means attached to rigid opening means surrounding said forward aperture, said guy means and said rigid opening means for allowing air to be rammed into said inflation inlets at said tapered, aft portion to increase and maintain air pressure within said envelope.

* * * * *